US010188960B2

(12) United States Patent
Berglund et al.

(10) Patent No.: US 10,188,960 B2
(45) Date of Patent: Jan. 29, 2019

(54) INTERLOCKING BUILDING BLOCK

(71) Applicants: Mina Mangano Berglund, Park City, UT (US); Taylor Paige DaBell, Park City, UT (US); Gates Arnold Lamb, Park City, UT (US); Michael Wong, Park City, UT (US)

(72) Inventors: Mina Mangano Berglund, Park City, UT (US); Taylor Paige DaBell, Park City, UT (US); Gates Arnold Lamb, Park City, UT (US); Michael Wong, Park City, UT (US)

( * ) Notice: Subject to any disclaimer, the term of this patent is extended or adjusted under 35 U.S.C. 154(b) by 1118 days.

(21) Appl. No.: 14/536,608

(22) Filed: Nov. 8, 2014

(65) Prior Publication Data

US 2015/0190725 A1 Jul. 9, 2015

Related U.S. Application Data

(60) Provisional application No. 61/925,396, filed on Jan. 9, 2014.

(51) Int. Cl.

| | |
|---|---|
| ***A63H 33/04*** | (2006.01) |
| ***A63H 33/06*** | (2006.01) |
| ***A63F 9/12*** | (2006.01) |

(52) U.S. Cl.

CPC ..... *A63H 33/062* (2013.01); *A63F 9/12* (2013.01); *A63H 33/046* (2013.01); *A63H 33/065* (2013.01); *A63F 2009/124* (2013.01)

(58) Field of Classification Search

CPC ..... A63H 33/04; A63H 33/046; A63H 33/06; A63H 33/08; A63H 33/086

USPC ..... 446/85, 108, 115, 116, 120, 124, 125

See application file for complete search history.

(56) References Cited

U.S. PATENT DOCUMENTS

| | | | | |
|---|---|---|---|---|
| 4,055,019 | A * | 10/1977 | Harvey | A63F 9/12 446/115 |
| 4,509,930 | A * | 4/1985 | Schweigert | A63H 33/065 220/4.29 |
| 4,685,892 | A * | 8/1987 | Gould | A63H 33/062 446/109 |
| 4,731,041 | A * | 3/1988 | Ziegler | A63H 33/065 446/102 |
| 4,736,550 | A * | 4/1988 | Hawranick | E04B 2/12 52/574 |

(Continued)

OTHER PUBLICATIONS

Spongebob Squarepants 3D Sphere Puzzle, Downloaded from http://ttpm.com/p/3459/cardinal-games/spongebob-squarepants-3d-sphere-puzzle/, Nov. 8, 2014.

*Primary Examiner* — Alexander Niconovich

(57) ABSTRACT

An apparatus, system, and method are disclosed for building a structure that includes a substantially triangular cross-sectional shape having an outside face opposing an inside face. The outside face is connected to the inside face by a first wall, a second wall, and a third wall. Each wall includes a first projection has an outer surface that is continuous with the outside face, a first recess that is positioned opposite and extends away from the first projection, a second projection that has an inner surface that is continuous with the inside face, a second recess that is positioned opposite and extends away from the second projection, and a coupling projection. The coupling projection is positioned opposite at least one of the first recess and the second recess.

23 Claims, 12 Drawing Sheets

(56) References Cited

U.S. PATENT DOCUMENTS 4,968,040 A * 11/1990 McElhaney ..... A63F 9/20 273/290
5,100,358 A * 3/1992 Volgger ..... A63H 33/08 446/104
5,501,626 A * 3/1996 Harvey ..... A63H 33/04 446/104
5,560,151 A * 10/1996 Roberts ..... E04B 1/3205 52/245
5,732,518 A * 3/1998 Roberts ..... E04B 1/3205 52/245
6,076,318 A * 6/2000 Grimm ..... E04B 1/3205 426/122
6,152,797 A * 11/2000 David ..... A63H 33/08 434/403
6,186,855 B1 * 2/2001 Bauer ..... A63H 33/04 446/104
6,186,856 B1 * 2/2001 Chen ..... A63H 33/04 446/117
6,508,690 B2 * 1/2003 Axelrad ..... A63H 33/04 446/108
6,648,715 B2 * 11/2003 Wiens ..... A63H 33/062 446/121
7,905,757 B1 * 3/2011 Stapleton ..... A63H 33/04 446/124
7,976,024 B1 * 7/2011 Stapleton ..... A63H 33/065 273/156
8,157,608 B1 * 4/2012 Stapleton ..... A63H 33/08 273/153 P
9,669,324 B2 * 6/2017 Roth ..... A63H 33/062
9,782,687 B2 * 10/2017 Bagley ..... A63H 33/046
2006/0084300 A1 * 4/2006 Kowalski ..... A63H 33/046 439/100
2013/0165012 A1 * 6/2013 Klauber ..... A63H 33/062 446/91

* cited by examiner

INTERLOCKING BUILDING BLOCK

CROSS-REFERENCES TO RELATED APPLICATIONS

This application claims the benefit of U.S. Provisional Patent Application No. 61/925,396 entitled "AN INTERLOCKING BUILDING BLOCK" and filed on Jan. 9, 2014 for Berglund et al., which is incorporated herein by reference.

FIELD

This invention relates to building blocks and more particularly relates to building blocks that combine to create interlocking three-dimensional structures.

BACKGROUND

Toy blocks (also building bricks, building blocks, or simply blocks), are wooden, plastic or foam pieces of various shapes and colors that are used as construction toys. Contemporary building blocks are limited in available shapes. Typical building blocks shapes include squares, rectangles, cylinders, and the like. Toy blocks build strength in a child's fingers and hands, and improve eye-hand coordination. They also help educate children in different shapes. Children can potentially develop their vocabularies as they learn to describe sizes, shapes, and positions. Math skills are developed through the process of grouping, adding, and subtracting, particularly with standardized blocks, such as unit blocks. Experiences with gravity, balance, and geometry learned from toy blocks also provide intellectual stimulation.

Building blocks have been historically and are currently available in diverse range of materials and are used to compose two and three-dimensional structures ranging from floor tiles and bricks of all shapes and sizes to spherical jigsaw puzzles and even geodesics. The means to temporarily attach one building block to another limits the combinatorial possibilities of building blocks. Common coupling means to temporarily combine building blocks include the use of pressure and compression fit such as a simple pin in slot solution (i.e., Lego or wooden dowel constructions sets). The use of a pin and slot coupling system limits the universe of possible shapes as at least one of the shapes must include a pin and at least one of the shapes must include a slot.

Other building blocks use screw fits such as with nuts and bolts (i.e., conventional erector sets). Sticky tape and hook and loop fastening systems (i.e., Velcro) have been used to combine two or more building blocks. The use of nuts and bolts and/or sticky tape or hook and loop fasteners introduces additional elements and unnecessarily increases the costs associated with such building block systems.

Often building blocks are combined utilizing pressure induced by gravity in a way that is an extension of the traditional Roman arch combined with three-dimensionally layered male-female tab and slot structure called keys and keyways. Combining building blocks in this manner has advantages over simple pressure fit combinatorial building blocks as no physical pressure is required just simple fit and a reliance on arch like formations to create a gravitational pressure fit. However, this type of building block coupling also has disadvantages. One disadvantage with building blocks that use the traditional Roman arch and key and keyway coupling means is that typically multiple blocks must be used to create the arch. That is, typically two blocks cannot be combined with one another.

SUMMARY

A limitation of existing means to temporarily combine building blocks is that either means to connect limits the means to disconnect, or the means to connect is limited by the means to disconnect. For example a Lego connection is limited by the force needed to disconnect. Accordingly it is desirable to find a means to temporarily connect in a durable fashion whilst providing the means to disconnect with a minimum amount of force. In one aspect of this invention a means to connect in a durable fashion is provided with a means to disconnect that requires minimum force where the means is a combination of leverage pressure and flex provided by the hereinafter described design structure.

From the foregoing discussion, it should be apparent that a need exists for an apparatus, system, and method that incorporates building block for creating complex three dimensional structures. The present invention has been developed in response to the present state of the art, and in particular, in response to the problems and needs in the art that have not yet been fully solved by currently available building blocks.

The apparatus for building a structure, according to one embodiment, includes a substantially triangular cross-sectional shape having an outside face opposing an inside face. The outside face is connected to the inside face by a first wall, a second wall, and a third wall. Each of the walls includes a first projection, a first recess, a second projection, a second recess, and a coupling projection. The first projection has an outer surface that is continuous with the outside face. The first recess is positioned opposite and extends away from the first projection. The first recess is created in the inside face of the substantially triangular cross-sectional shape. The second projection has an inner surface that is continuous with the inside face. The second recess is positioned opposite and extends away from the second projection. The second recess is formed in the outside face of the substantially triangular cross-sectional shape. The coupling projection is positioned opposite at least one of the first recess and the second recess.

The coupling projection and the first recess, in certain embodiments, define a gap for receiving at least a portion of either a first projection or the second projection of a second building block. In an exemplary embodiment, the gap is sized to require pressure to matingly receive at least one of the first projection and the second projection of the second building block.

In another embodiment the apparatus also includes a void that extends through the building block from the outside face to the inside face. In such an embodiment, the coupling projection is positioned opposite the void. In one embodiment, the first projection, the second projection, or both includes at least one detent. The detent is shaped to removably engage a void on a second building block to removably couple the second building block to the first building block. In another embodiment, the detent and the void are sized to require leverage and pressure to removably engage the detent with the void.

In a further embodiment, the outside face of the building block is shaped as a portion of an outer surface of a sphere. In another embodiment, the inside face of the building block is also shaped as a portion of an inner surface of a sphere.

In certain embodiments, the apparatus includes two building blocks. In such an embodiment the outside face of the first building block includes a coupling element configured to couple a second building block to the outside face of the first building block. In one embodiment, the coupling element may be at least one receiving slot sized to receive the first projection the second building block, the second projection of the second building block, or both. The second building block also includes an outside face positioned opposite an inside face. The outside face and the inside face of the second building block extend substantially perpendicularly away from the outside face of the first building block when the second building block is coupled to the first building block.

In yet another embodiment, the building blocks include a first magnetic element and a second magnetic element. The first magnetic element is positioned on at least one of the first projection and the second projection. The second magnetic element is positioned in at least one of the first recess and the second recess. In such an embodiment, the first magnetic element is magnetically coupleable to the second magnetic element to removably couple two building blocks to one another.

An apparatus for building a structure is also disclosed which includes a first building block and a second building block. The first building block includes a first building block substantially triangular cross-sectional shape having a first building block outside face opposing a first building block inside face. The first building block outside face is connected to the first building block inside face by a first building block first wall, a first building block second wall, and a first building block third wall. At least one of the first building block first wall, the first building block second wall, and the first building block third wall includes a first building block first projection, a first building block first recess, a first building block second projection, a first building block second recess, and a first building block coupling projection.

The first building block first projection includes a first building block outer surface that is continuous with the first building block outside face. The first building block first projection extends away from either the first building block first wall, the first building block second wall, or the first building block third wall.

The first building block first recess is positioned opposite from and extends away from the first building block first projection. The first building block first recess is disposed in the first building block inside face of the first building block substantially triangular cross-sectional shape.

The first building block second projection includes a first building block inner surface that is continuous with the first building block inside face. The first building block second projection extends away from the first building block first wall, the first building block second wall, or the first building block third wall.

The first building block second recess is positioned opposite from and extends away from the first building block second projection. The first building block second recess is disposed in the first building block outside face of the first building block substantially triangular cross-sectional shape.

The first building block coupling projection is positioned opposite either the first building block first recess or the first building block second recess. The first building block coupling projection and either the first building block first recess or the first building block second recess define a first building block gap.

The second building block includes a second building block first projection and a second building block second projection. In such an embodiment, the first building block gap is sized to receive a portion of either the second building block first projection or the second building block second projection to removably couple the first building block to the second building block. In an exemplary embodiment, either the second building block first projection or the second building block second projection is matingly receivable within the gap to maintain the coupling between the first building block and the second building block.

The second building block, in one embodiment, includes a substantially triangular cross-sectional shape having a second building block outside face opposing a second building block inside face. The second building block outside face is connected to the second building block inside face by a second building block first wall, a second building block second wall, and a second building block third wall. At least one of the second building block first wall, the second building block second wall, and the second building block third wall includes a second building block first projection, a second building block first recess, second building block second projection, a second building block second recess, and a second building block coupling projection.

The second building block first projection includes a second building block outer surface that is continuous with the second building block outside face. The second building block first projection extends away from the second building block first wall, the second building block second wall, or the second building block third wall.

The second building block first recess is positioned opposite from and extends away from the second building block first projection. The second building block first recess is disposed in the second building block inside face of the second building block substantially triangular cross-sectional shape.

The second building block second projection includes a second building block inner surface that is continuous with the second building block inside face. The second building block second projection extends away from the second building block first wall, the second building block second wall, or the second building block third wall.

The second building block second projection has a second building block inner surface that is continuous with the second building block inside face. The second building block second projection extends away from the second building block first wall, the second building block second wall, or the second building block third wall.

The second building block second recess is positioned opposite and extends away from the second building block second projection. The second building block second recess is disposed in the second building block outside face of the second building block substantially triangular cross-sectional shape.

The second building block coupling projection is positioned opposite either the second building block first recess or the second building block second recess. The second building block coupling projection and the either the second building block first recess or the second building block second recess define a second building block gap for receiving a first projection or a second projection on another building block.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided for a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The term geodesic, as used in this specification, refers to circles of a sphere. It includes bodies having the form of a portion of a sphere. It also includes polygonal bodies whose sides are so numerous that they appear to be substantially spherical.

The term icosahedron, as used herein, describes a polyhedron having twenty faces.

The term spherical icosahedron refers to an icosahedron which has been "exploded" onto the surface of a sphere. It bears the same relationship to an icosahedron as a spherical triangle bears to a plane triangle. The sides of the faces of the spherical icosahedron are all geodesic lines.

As discussed above, a limitation of existing means to temporarily combine building blocks is that either means to connect limits the means to disconnect, or the means to connect is limited by the means to disconnect. For example a Lego connection is limited by the force needed to disconnect. Accordingly it is desirable to find a means to temporarily connect in a durable fashion whilst providing the means to disconnect with a minimum amount of force. In one aspect of this invention a means to connect in a durable fashion is provided with a means to disconnect that requires minimum force where the means is a combination of leverage pressure and flex. By combining pressure with leverage as a disconnecting force, the present invention provides a convenient and simply method of coupling and uncoupling two building blocks.

Figure 1:
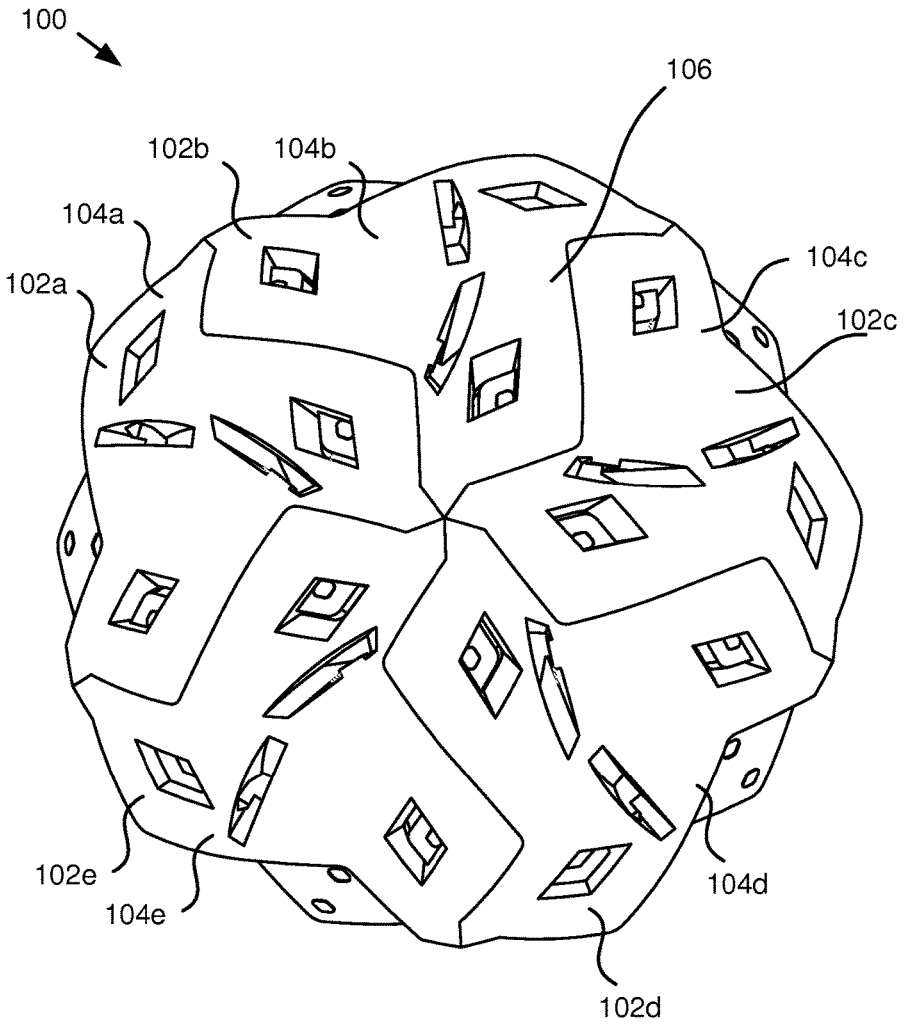
FIG. 1 depicts one embodiment of a portion of an icosahedron which has been exploded onto the surface of a sphere.

FIG. 1 depicts one embodiment of a portion 100 of an icosahedron which has been exploded onto the surface of a sphere. In the embodiment illustrated in FIG. 1, the portion 100 of the icosahedron includes five building blocks 102*a*-102*e* (collectively building blocks 102). One of skill in the art will recognize that a full spherical icosahedron will comprise twenty building blocks 102.

In certain embodiments, an outside face 104*a*-104*e* (collectively outside faces 104) of each of the building blocks 102 is substantially convex such that an outer surface 106 of the icosahedron forms a sphere when the twenty building blocks 102 are positioned adjacent one another.

In one embodiment, the outside faces 104 of each of the building blocks 102 contain a unique designation such that a spherical icosahedron depicts a spherical image. For example, in certain embodiments the outside faces 104 of the building blocks 102 may each include a portion of a spherical image of the planet earth. In such an embodiment, when correctly positioned, the outer surface 106 of the spherical icosahedron will look like the planet earth. In other embodiment, the spherical icosahedron may include other spherical images (i.e., a basketball, baseball, soccer ball, etc.)

While the embodiments illustrated in the accompanying figures depict an icosahedron, one of skill in the art will recognize that in certain embodiments the apparatus may be a truncated icosahedron. That is, in one embodiment, the apparatus may include building blocks that consist of two or more types of regular polygons. Building blocks that make up other Archimedean solids are within the scope of the present disclosure.

In a preferred embodiment, the building blocks 102 are made of a plastic material. In an exemplary embodiment, the building blocks 102 are made of a thermoplastic material comprising a polymer that softens when exposed to heat and returns to its original condition when cooled to room temperature. Natural substances that exhibit such behavior include crude rubber and a number of waxes. Similarly, the thermoplastic material may comprise synthetic materials such as polyvinyl chloride, nylons, fluorocarbons, linear polyethylene, polyurethane prepolymer, polystyrene polypropylene, polycarbonates, acrylonitrile/butadiene/styrene, cellulosic resins, acrylic resins, etc.

In another embodiment, the building blocks 102 comprise a thermoset plastic. A thermoset plastic is a high polymer that solidifies or sets irreversibly when heated. Examples of thermosetting materials that may be used to construct building blocks 102 include linear polyethylene crosslinked to a thermosetting material through radiation or a chemical reaction. Phenolics, allyls, melamines, urea-formaldehyde resins, alkyds, amino resins, polyesters, epoxides, and silicones are usually considered to be thermosetting, but the term also applies to materials where additive-induced crosslinking is possible.

In yet another aspect of the present subject matter, the building blocks 102 consist of a foamed plastic such as polyurethane foam, polystyrene foam, polyethylene foam, etc. One of skill in the art will recognize other types of plastic material may be used to construct the building blocks 102.

In certain embodiments, the building blocks 102 comprise a ceramic material. As used in this specification, a ceramic material refers to a solid material produced from essentially inorganic, non-metallic substances. Examples of a ceramic material suitable for forming building blocks 102 are concrete, ceramic whiteware, basic brick, clay, shale, etc. One of skill in the art will recognize other materials suitable for creating building blocks 102.

In one embodiment, as further discussed below, the material that makes up the building blocks 102 is a material having a durometer sufficient to require pressure and leverage to matingly couple at least two building blocks 102. For example, in certain embodiments, the building blocks have a durometer within a range of about 40-95. Materials having a durometer within this range have sufficient rigidity to maintain the shape of each of the building blocks while still allowing enough flex to couple each building block to one or more adjacent building blocks.

Figure 2A:
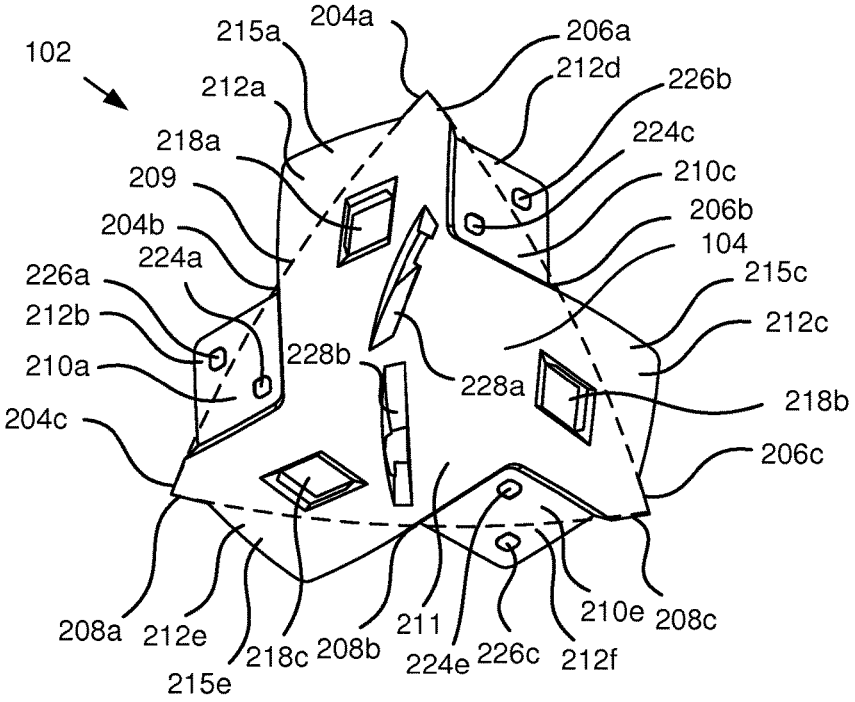
FIG. 2A is a top view further illustrating one of the building blocks of FIG. 1 in accordance with the present subject matter.
Figure 2B:
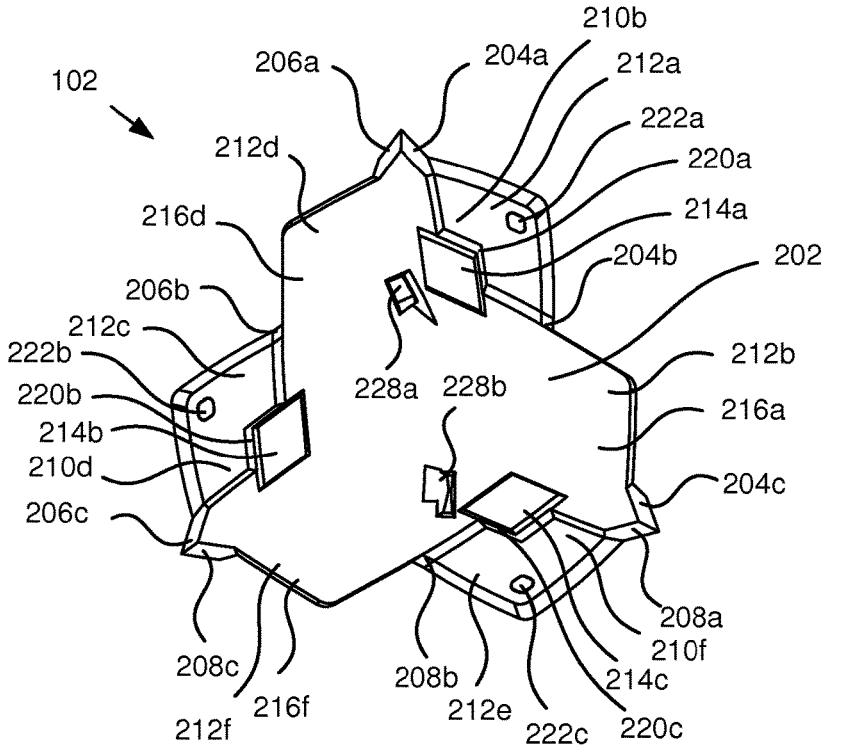
FIG. 2B is a bottom view further illustrating one of the building blocks of FIG. 1 in accordance with the present subject matter.

FIG. 2A is a top view further illustrating one of the building blocks 102 of FIG. 1 in accordance with the present subject matter. FIG. 2B is a bottom view further illustrating one of the building blocks 102 of FIG. 1 in accordance with the present subject matter.

In certain embodiments the building block 102 is a substantially triangular cross-sectional shape 211. In the embodiment depicted in FIG. 2A, dashed line 209 has been added to highlight the triangular cross-sectional shape 211 of the building block 102. One of skill in the art will recognize that the dashed line 209 has been added to FIG. 2A for illustrative purposes and does not form a part of the unique subject matter of the present disclosure.

With reference to both FIG. 2A and FIG. 2B, in one embodiment, the building block 102 includes an outside face 104, an inside face 202, a first wall 204, a second wall 206, and a third wall 208. The outside face 104 opposes the inside face 202 and is connected to the inside face 202 by the first wall 204, the second wall 206, and the third wall 208.

In one embodiment, the outside face 104 is shaped as a portion of an outer surface of a sphere. In such an embodiment, the outside face 104 is convex in an infinite number directions to form a shape substantially similar to at least a portion of a sphere. In certain embodiments, the inside face 202 of the building block 102 is shaped as a portion of an inner surface of a sphere. That is, in one embodiment, the inside face 202 is concave in an infinite number directions to form a shape that would matingly receive an outer surface of at least a portion of a sphere. Accordingly, in one embodiment, a thickness of the building block 102 is substantially constant such that the convex outside face 104 of the building block 102 is mirrored in the concave inside face 104 of the building block 102. In other embodiments, the thickness of the building block 102 may be varied while still maintaining a substantially spherical outside face 104 and/or inside face 202. In yet another embodiment, either the outside face 104 or the inside face 202 may be substantially flat while the other of either the outside face 104 or the inside face 202 is spherical.

In certain embodiments, the first wall 204, the second wall 206, and the third wall 208 may be considered to extend along the entire length of each side of the substantially triangular cross-sectional shape 211 of the building block 102. Thus, in the embodiments illustrated in FIGS. 2A and 2B there are three "204" designations for the first wall 204, one at each end of the first wall (204*a* and 204*c*), and one in the middle of the first wall 204 (204*b*). Similarly, there are three "206" designations for the second wall 206, and three "208" designations for the third wall 208, one at each end of the second wall 206 (206*a* and 206*c*) and the third wall 208 (208*a* and 208*c*) respectively and one in the middle of the second wall 206 (206*b*) and the third wall 208 (208*b*) respectively.

In one embodiment, the first wall 204 includes two recesses 210*a* and 210*b*. In the embodiment illustrated in FIGS. 2A and 2B the recesses 210*a* and 210*b* are triangular-shaped and extend away from the first wall 204 towards the center of the building block 102. The recesses 210*a* and 210*b*, in an exemplary embodiment, are positioned between the outside face 104 and the inside face 202. Thus, the embodiment illustrated in FIG. 2A depicts a first recesses (recess 210*a*) as being disposed at a height substantially lower than the surface of the outside face 104. In FIG. 2A the first projection 212*a* obscures a second recess (recess 210*b*). The second recess 210*b* is more clearly seen in FIG. 2B. In certain embodiments, recess 210*b* is disposed at a height substantially lower the surface of the inside face 202.

In one embodiment, at least one of the recesses (the first recess 210*a* and/or the second recess 210*b*) includes a first void 218*a*. In the embodiment illustrated in FIGS. 2A and 2B, the first void 218*a* is diamond-shaped. The first void 218*a* extends through the building block 102 from the outside face 104 to the inside face 202. The first void 218*a* is positioned opposite a first coupling projection 214*a* to form a first gap 220*a* which is described in more detail below.

The first wall also includes a first projection 212*a* and a second projection 212*b* that extend away from the center of the building block 102. In the embodiment illustrated in FIGS. 2A and 2B, the first projection 212*a* and the second projection 212*b* are triangular-shaped. The recesses 210*a* and 210*b* are sized and shaped to receive projections such as a first and second projections 212*a* and 212*b* on a second building block i.e., any of the other building blocks 102*a*-102*b*. Each of the first wall 204, the second wall 206, and the third wall 208 are substantially similar such that at least one of the projections extending from any of the walls (204, 206, or 208) may be matingly received within at least one of the recesses from any of the other walls (204, 206, or 208).

As discussed above, in certain embodiments, the building blocks 102 are made of a material having flex qualities that, while maintaining the shape of the building blocks 102, facilitate coupling between two or more building blocks 102. For example, in an exemplary embodiment, the building blocks 102 are made of a material that requires either pressure, leverage, or both to position a second projection 212 within one of the gaps 220. Once positioned within the one of the gaps 220, the second projection 212 may require pressure to remove the second projection 212 from within the gap 220. This pressure may be applied by pulling on the two building blocks 102 or by applying leverage to opposing ends of the two building blocks 102. In certain embodiments, the material that the building blocks are made of has a durometer in the range of about 40-95. This durometer range has been demonstrated to optimize the engagement and disengagement between two or more building blocks 102.

In one embodiment, the first projection 212*a* has an outer surface 215*a* that is continuous with the outside face 104 of the building block 102. Thus, in certain embodiments, there is no transition between the outer surface 215*a* of the first projection 212*a* and the outside face 104 of the building block 102. Similarly, in one embodiment, the second projection 212*b* has an inner surface 216*a* that is continuous with the inside face 202 such that there is substantially no transition between the inside face 202 of the building block 102 and the inner surface 202 of the second projection 212*b*.

In an exemplary embodiment, the first gap 220*a* is disposed between the first coupling projection 214*a* and either the first projection 212*a* or the second projection 212*b* depending on where the first void 218*a* is located. The first coupling projection 214*a* extends from the inside face 202 of the building block 102 such that the first gap 220*a* is sufficiently wide to receive any of the projections on another building block 102*a*-102*e* to keep the other building block from rotating when the projections are matingly received within the recesses.

As discussed above, in certain embodiments, each of the first wall 204, the second wall 206, and the third wall 208 are shaped substantially similar. Thus, in one embodiment, the second wall 206 includes two recesses 210*c* and 210*d*, a third projection 212*c*, a fourth projection 212*d*, and a second coupling projection 214*b* Like the first projection 212*a*, the third projection 212*c* has an outer surface 215*c* that is continuous with the outside face 104. Similarly, the fourth projection 212*d* has an inner surface 216*d* that is continuous with the inside face 202 of the building block 102. The recesses 210*c* and 210*d* on the second wall 206 are positioned between the outside face 104 and the inside face 202 of the building block 102. At least one of the triangular-shaped recesses 210*c* and 210*d* includes a second void 218*b* that extends through the building block 102 from the outside face 104 to the inside face 202. The second coupling projection 214*b* is positioned opposite the second void 218*b* to form a second gap 220*b* sufficiently wide to receive any of the projections on another building block 102*a*-102*e* to keep the other building block from rotating when the projections are matingly received within the recesses. The second gap 220*b* is disposed between the second coupling projections 214*b* and either the third projection 212*c* or the fourth projection 212*d* depending on where the second void 218*b* is located.

Like the first wall 204 and the second wall 206, the third wall 208 also includes two recesses 210*e* and 210*f*, a fifth projection 212*e*, a sixth projection 212*f*, and a third coupling projection 214*c*. The fifth projection 212*e* has an outer surface 215*e* that is continuous with the outside face 104 of the building block 102. Similarly, the sixth projection 212*f* has an inner surface 216*f* that is continuous with the inside face 202 of the building block 102. The recesses 210*e* and 210*f* on the third wall 208 are positioned between the outside face 104 and the inside face 202 of the building block 102. At least one of the triangular-shaped recesses 210*e* and 210*f* includes a third void 218*c* that extends through the building block 102 from the outside face 104 to the inside face 202. The third coupling projection 214*c* is positioned opposite the third void 218*c* to form a third gap 220*c* sufficiently wide to receive any of the projections on another building block 102*a*-102*e* to keep the other building block from rotating when the projections are matingly received within the recesses. The third gap 220*c* is disposed between the third coupling projection 214*c* and either the fifth projection 212*e* or the sixth projection 212*e* depending on where the third void 218*c* is located.

In one embodiment, the first gap 220*a*, the second gap 220*b*, and the third gap 220*c* are all sized to receive any of the projections. In other embodiments, each of the projections may have differing cross-sectional dimensions. In such an embodiment, the dimensions of first gap 220*a*, the second gap 220*b*, and/or the third gap 220*c* may be altered according to the dimensions of the triangular-shaped projection to be received therein.

While the embodiments illustrated in the accompanying figures depict diamond-shaped coupling projections (i.e., coupling projections 214*a*-214*c*), one of skill in the art will recognize that in other embodiments the projections may include a shape other than a diamond shape. Further, one of skill in the art will also recognize that in certain embodiments the projections may include multiple projections of any shape. In either embodiment, the projections form gaps (i.e., gaps 220*a*-220*c*) sized to receive any of the projections (i.e., projections 412*a*-412*c*).

In certain embodiments, the projections 212*a*-212*e* include detents configured to assist in coupling one building block 102 to another building block 102. For example, in one embodiment, the first projection 212*a* includes a detent projection 222*a* that is sized and shaped to be received within a detent receiving space 224*a*, 224*c* or 224*e* to assist in maintaining the first projection 212*a* positioned within one of the recesses 210*a*, 210*c*, or 210*e* on another building block 102. Similarly, the third projection 212*c* and the fifth projection 212*e* may also include detent projections 222*b* and 222*c* respectively which are sized and shaped to be received within a detent receiving space 224*a*, 224*c* or 224*e* to assist in maintaining the third projection 212*c* or the fifth projection 212*e* within one of the recesses 210*a*, 210*c*, or 210*e* on another building block 102.

In one embodiment, the projections 212*a*-212*e* may also contain projections 226*a*-226*c* configured to engage one of the first void 218*a*, the second void 218*b*, and the third void 218*c*. Engagement of one of the projections 226*a*-226*c* with the voids 218*a*-218*c* assists in maintaining one of the second projection 212*b*, the fourth projection 212*d*, or the sixth projection 212*f* positioned within one of the recesses 210*b*, 210*d*, and 210*f*. In this manner, two building blocks 102 are removably coupled to and interlock with one another when the first projection 212*a*, the third projection 212*c*, or the fifth projection 212*e* is positioned within one of the gaps 220*a*-220*c* and the detent projections 222*a*, 222*b* or 222*c* are received within a detent receiving space 224*a*, 224*c* or 224*e*. In certain embodiments, engagement between projections 226*a*-226*c* and the first void 218*a*, the second void 218*b*, or the third void 218*c* also assists in removably coupling two building blocks 102 to one another. Thus, two building blocks 102 may be removably coupled to one another without the need for additional coupling elements or additional building blocks 102.

In one embodiment, the outside face 104 includes at least one coupling element 228*a* and 228*b*. The coupling elements 228*a* and 228*b* are configured to couple a second building block 102 to the outside face 104 of the building block 102. In an exemplary embodiment, the coupling elements 228*a* and 228*b* are receiving slots sized to receive at least one of the first projection 212*a*, the second projection 212*b*, the third projection 212*c*, the fourth projection 212*d*, the fifth projection 212*e*, and the sixth projection 212*f*. As can be seen in FIGS. 2A and 2B, in certain embodiments, the receiving slots 228*a* and 228*b* extend all the way through the building block 102 from the outside face 104 to the inside face 202.

Figure 3:
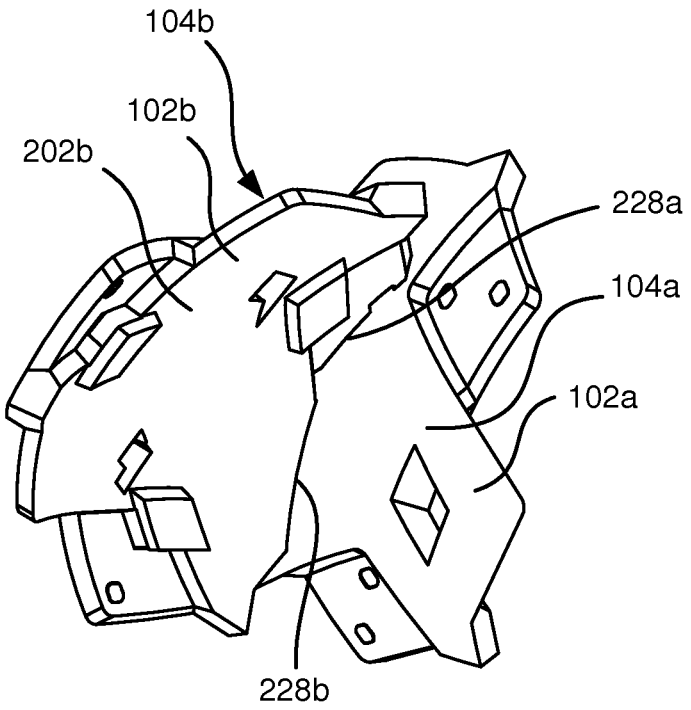
FIG. 3 is a perspective view illustrating one embodiment of a first building block and a second building block coupled to one another.

FIG. 3 is a perspective view illustrating one embodiment of a first building block 102*a* and a second building block 102*b* coupled to one another. The second building block 102*b* includes an outside face 104*b* positioned opposite an inside face 202*b*. In the embodiment illustrated in FIG. 3, the outside face 104*b* and the inside face 202*b* of the second building block 102*b* extend substantially perpendicularly away from the outside face 104*a* of the first building block 104*a* when the second building block 102*b* is coupled to the first building block 102*a*. In other embodiments, the receiving slots 228*a* and 228*b* may be altered to position the second building block 102*b* at an angle other than perpendicular to the outside face 104*a* of the first building block 102*a*.

While the embodiments discussed herein utilize receiving slots 228*a* and 228*b* to perpendicularly couple one building block 102*a* to another building block 102*b*, one of skill in the art will recognize other coupling elements that may be utilized.

Figure 4:
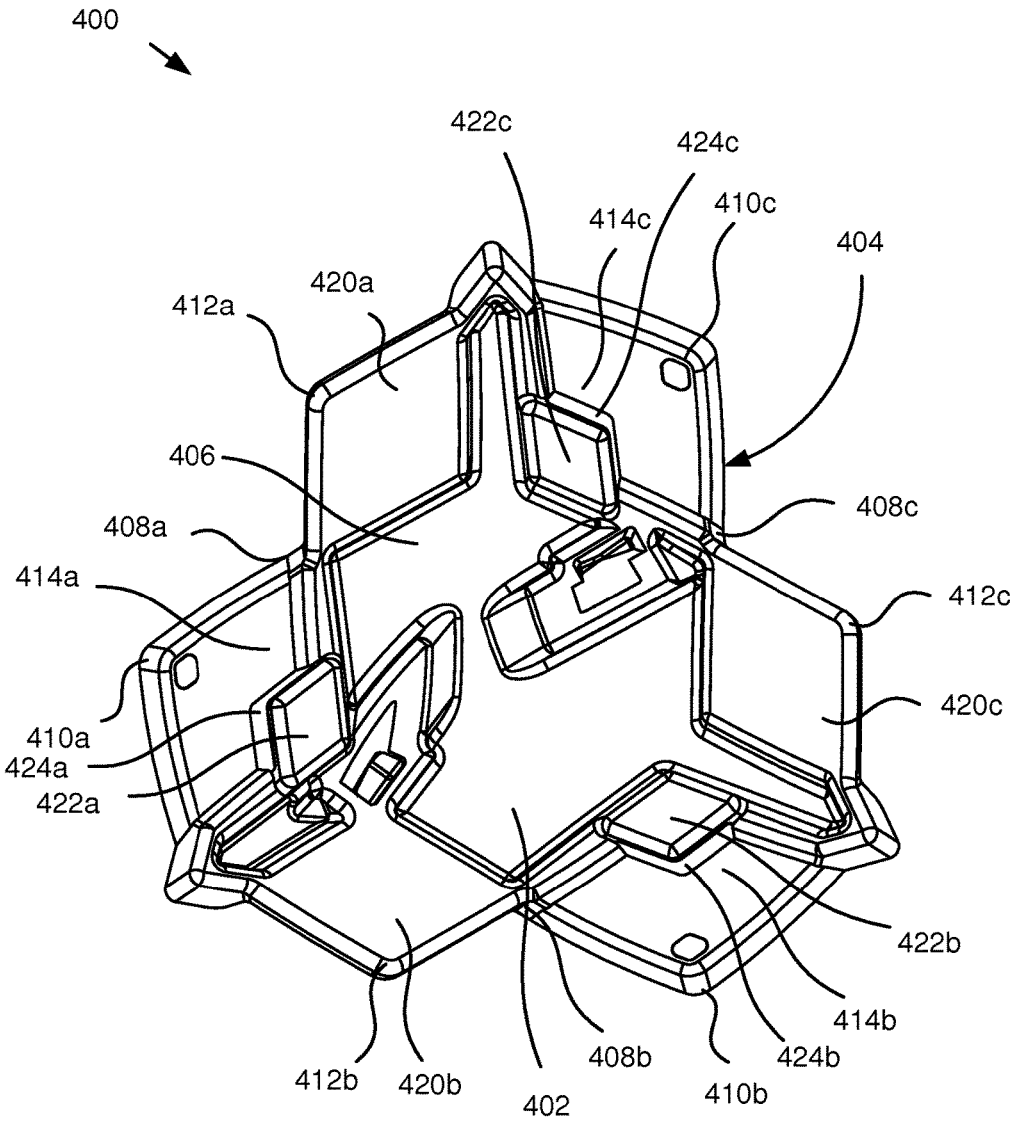
FIG. 4 is a bottom view illustrating a building block for building a structure in accordance with the present subject matter.
Figure 5:
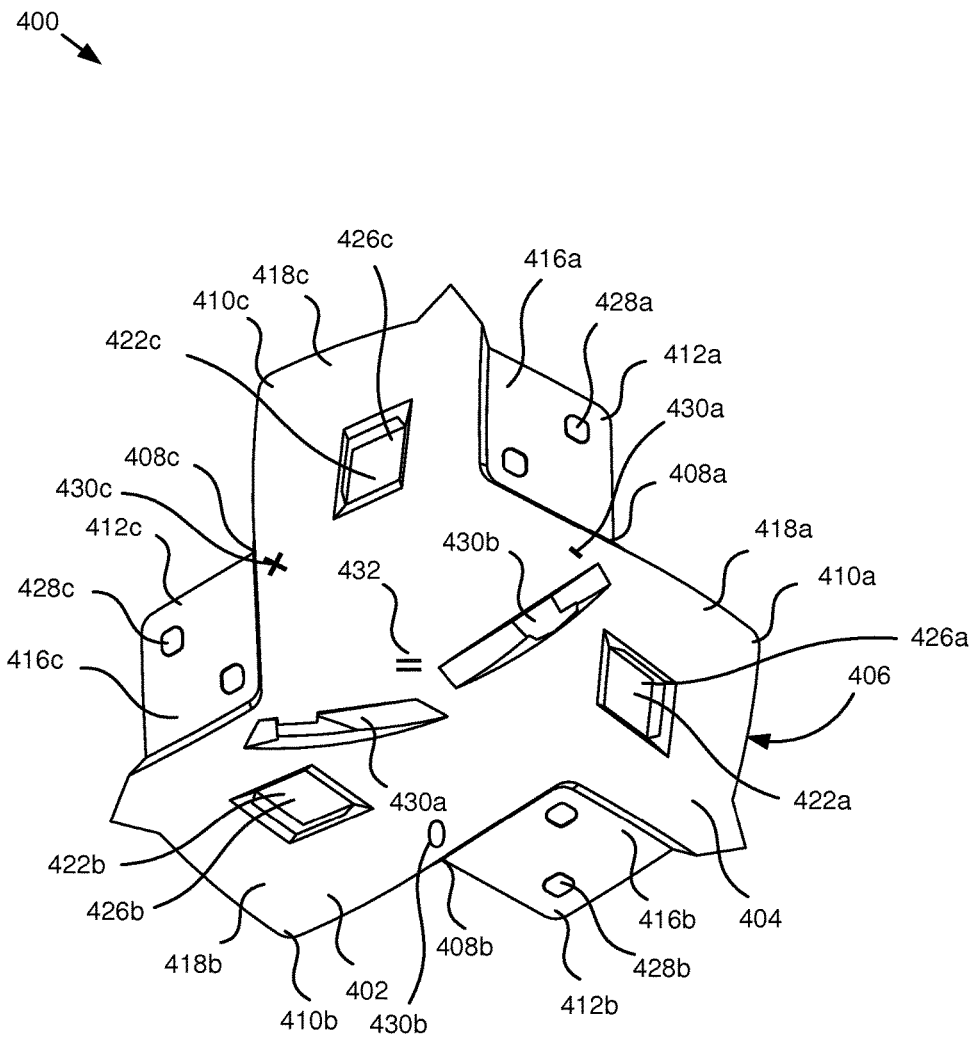
FIG. 5 is a top view illustrating a building block for building a structure in accordance with the present subject matter.

FIG. 4 is a bottom view illustrating a building block 400 for building a structure in accordance with the present subject matter. FIG. 5 is a top view illustrating a building block 400 for building a structure in accordance with the present subject matter.

In certain embodiments, the building block 400 includes a substantially triangular cross-sectional shape 402. The triangular cross-sectional shape 402 includes an outside face 404 and an inside face 406. One of skill in the art will recognize that the view illustrated in FIG. 4 shows a bottom view of the triangular cross-sectional shape 402. Therefore, only the inside face 406 is viewable is viewable in FIG. 4. Similarly, one of skill in the art will recognize that the view illustrated in FIG. 5 shows a top view of the triangular cross-sectional shape 402. Therefore, only the outside face 404 is viewable in FIG. 4.

The outside face 404 is connected to the inside face 406 by a first wall 408*a*, a second wall 408*b*, and a third wall 408*c* (collectively walls 408). Each of the walls 408 are substantially similarly shaped and include a first projection 410*a*, 410*b*, and 410*c* respectively (collectively first projections 410) and a second projection 412*a*, 412*b*, and 412*c* respectively (collectively second projections 412).

Each of the walls 408 also include a first recess 414*a*, 414*b*, and 414*c* respectively (collectively first recesses 414). Similarly, in certain embodiments, the walls 408 include a second recess 416*a*, 416*b*, and 416*c* respectively (collectively second recesses 416).

The first projections 410 have an outer surface 418*a*, 418*b*, and 418*c* that is continuous with the outside face 404 of the triangular cross-sectional shape 402. The second projections 412 have an inner surface 420*a*, 420*b*, and 420*c* that is continuous with the inside face 406 of the triangular cross-sectional shape 402.

The first recesses 414 are positioned opposite and extend away from the first projections 410. That is, the first recesses 414 are disposed in the inside face 406 of the substantially triangular cross-sectional shape 402 and extend along a curved plane of the inside face. Similarly, the second recesses 416 are positioned opposite the second projections 412. The second recesses 416 are disposed in the outside face 404 of the triangular cross-sectional shape 402 and extend away from the second projections 412.

In certain embodiments, each wall 408 also includes a coupling projection 422*a*, 422*b*, and 422*c* respectively (collectively coupling projections 422). The coupling projections 422, in one embodiment, are positioned opposite at either the first recesses 414, the second recesses 416, or both.

In the embodiments illustrated in FIGS. 4 and 5, the coupling projections 422 are positioned opposite first recesses 414. In such an embodiment, the coupling projections 422 and the first recesses 414 define a gap 424*a*, 424*b*, and 424*c* (collectively gaps 424) for receiving at least a portion of a second projection 412 of a second building block.

In certain embodiments, the gaps 424 are sized to require pressure to matingly receive the second projection 412 of a second building block. For example, in one embodiment, the triangular cross-sectional shape 402 includes voids 426*a*, 426*b*, and 426*c* (collectively voids 426) that extend through the building block from the outside face 404 to the inside face 406. In such embodiment, the coupling projections 422 are positioned opposite the voids 426. Each of the second projections 412 include at least one detent 428*a*, 428*b*, and 428*c* respectively (collectively detents 428). The detents 428 are sized and shaped to removably engage the diamond voids 426 to keep two or more building blocks 400 coupled to one another. In an exemplary embodiment, the detents 428 and the voids 426 are sized to require leverage and pressure to removably engage two or more building blocks 400. While the second building block is not depicted in FIGS. 4 and 5, one of skill in the art will recognize that in certain embodiments, the second building block is constructed substantially similar to the first building block 400.

In other embodiments, the building blocks 400 may include magnetic elements (not shown) configured to facilitate removable coupling between two or more building blocks 400. For example, in one embodiment, instead of detents 428, each projection 410*a*-410*c* and 412*a*-412*c* may include a first magnetic element. Similarly, each recess 414*a*-414*c* and 416*a*-416*c* may include a second magnetic element. In such an embodiment, the first magnetic element may be magnetically coupleable to the second magnetic element to facilitate coupling between two or more building blocks 400.

In one embodiment, the outside face 404 includes at least one coupling element 430*a* and 430*b* (collectively coupling elements 430). The coupling elements 430 are configured to couple a second building block 400 to the outside face 404 of the building block 400. In an exemplary embodiment, the coupling elements 430 are receiving slots sized to receive at least one of the first projections 410 and the second projection 412 of a second building block 400. Thus, in the embodiment illustrated in FIG. 5, the coupling elements 430 have a tapered configuration to receive a triangular-shaped first projection and a triangular shaped second projection 412 on one side of a second building block. In certain embodiments, the coupling elements 430 extend all the way through the building block 400 from the outside face 404 to the inside face 402.

In one embodiment, each building block 400 is coupleable to at least four other building blocks 400. For example, a building block 400 may be coupled to each of the first wall 408*a*, the second wall 408*b*, and the third wall 408*c* of the building block 400. A fourth building block 400 is coupleable to the coupling elements 430 on the outside face 404 of the building block 400.

In certain embodiments, each edge 408 may include a unique symbol 430*a*, 430*b*, and 430*c*. Additionally, in one embodiment, the coupling elements 430 may also include a unique symbol 432. The unique symbols 430 and 432 may be used to instruct a user in creating a predefined arrangement of building blocks 400. Thus, in certain embodiments, a set of instructions may guide a user in creating a particular arrangement of building blocks 400.

Figure 6:
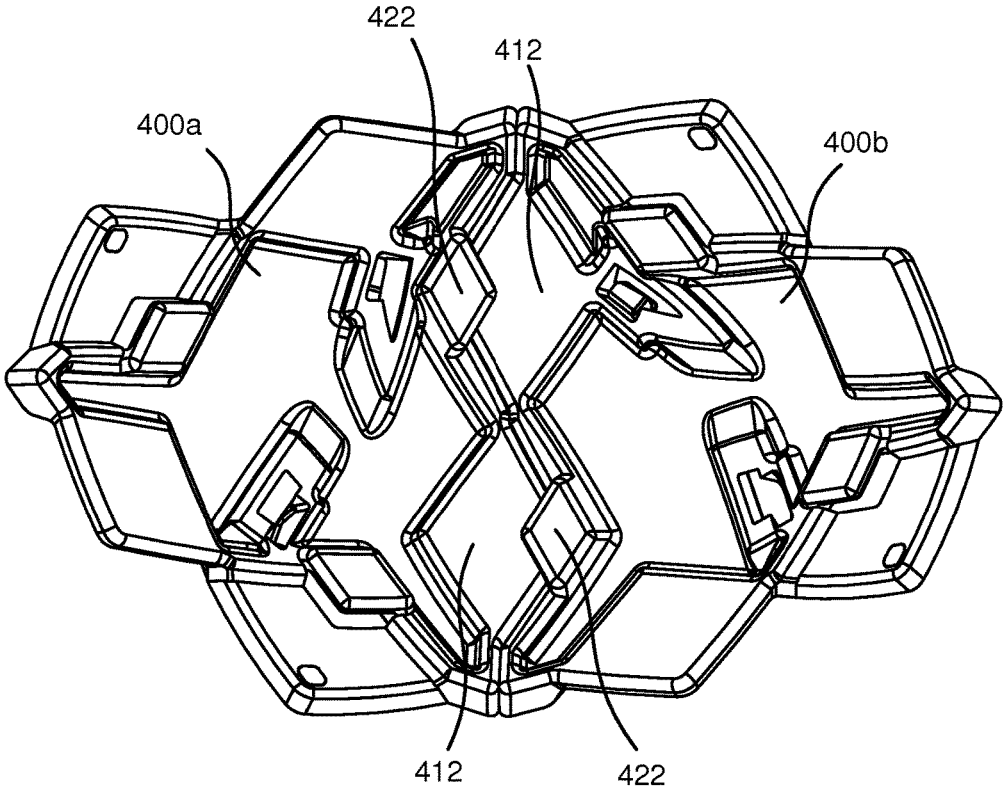
FIG. 6 is a bottom view illustrating two building blocks coupled to one another in accordance with the present subject matter.

FIG. 6 is a bottom view illustrating two building blocks 400*a* and 400*b* coupled to one another in accordance with the present subject matter. The building blocks 400*a* and 400*b* are substantially similar to the building block 400 described above. As can be seen in FIG. 6, in certain embodiments, when two building blocks 400*a* and 400*b* are removably coupled to one another, one of the second projections 412 from each of the two building blocks 400*a* and 400*b* is positioned within the gaps 424 defined by the coupling projections 422 and the first recess 414. This unique coupling arrangement allows two building blocks 400*a* and 400*b* to be coupled to one another along one of the walls 408 of each of the building blocks 400*a* and 400*b*.

Figure 7A:
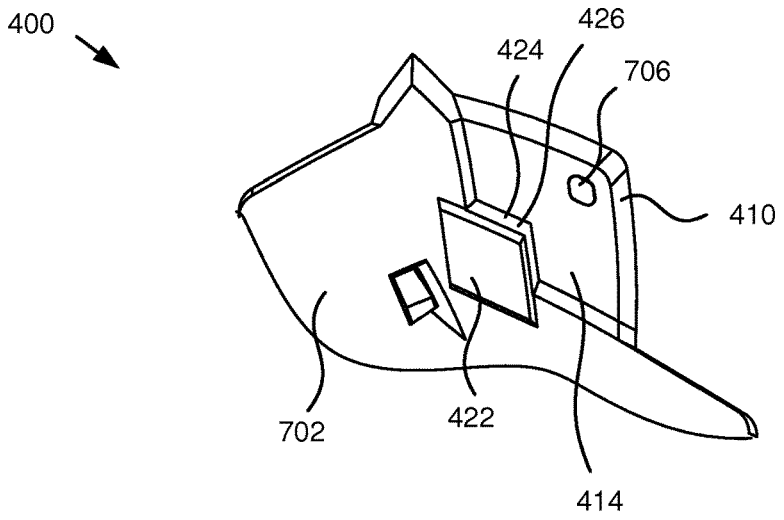
FIG. 7A is an enlarged bottom view of a portion of a building block further illustrating an embodiment of the first projection.

FIG. 7A is an enlarged bottom view of a portion 702 of a building block 400 further illustrating an embodiment of the first projection 410. Also illustrated in FIG. 7A is the first recess 414, the coupling projection 422 and the gap 424. In one embodiment, the first projection 410 includes a detent 706 that is sized and shaped to engage a detent recess 708 (see FIG. 7B) in a second recess 416 on a second building block 400 to facilitate removable coupling between two or more building blocks 400.

Figure 7B:
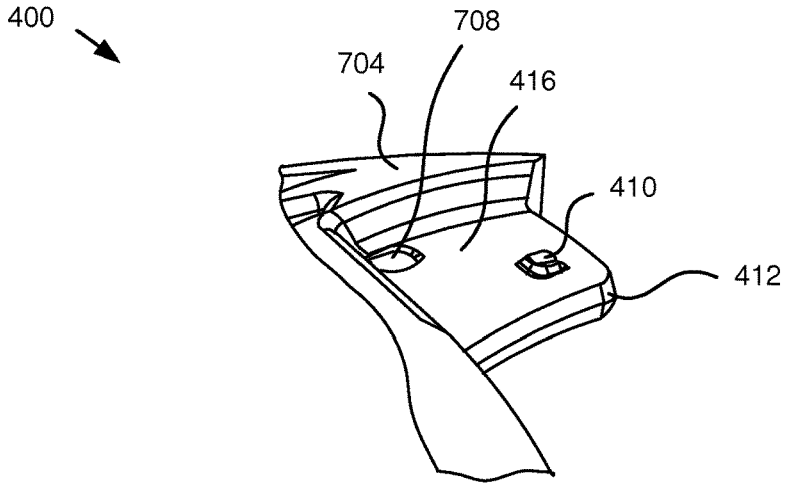
FIG. 7B is an enlarged top view of a portion of a building block further illustrating one embodiment of the second projection.

FIG. 7B is an enlarged top view of a portion 704 of a building block 400 further illustrating one embodiment of the second projection 412. The second projection 412 extends away from one side of the building block 400 opposite the second recess 416. As discussed above, the second recess 416 includes a detent recess 708 that is sized and shaped to engage a detent 706 on a first projection 410 of a second building block 400. The second projection 412 also includes a detent 410 that is sized and shaped to engage a void 426 on a second building block 400.

To couple two building blocks 400 to one another, two building blocks 400 are positioned adjacent one another so that the first projection 410 on one of the building blocks 400 is aligned with a second recess 416 on a second building block 400. In this position the second projection 412 on the second building block 400 is aligned with the first recess 414 on the first building block 400. In certain embodiments, pressure is applied to either or both of the building blocks 400 to force the second projection 412 into the gap 424. In other embodiments, the pressure may be applied by tilting opposing ends of either or both of the building blocks 400 to use the length of the building blocks 400 as levers to vary the amount of pressure used to couple the two building blocks 400. Tilting opposing ends of the two building blocks 400 also acts to align the detent 706 with the detent recess 708 and to align the detent 410 with the void 426 to removably couple the two building blocks 400 to one another.

Figure 8:
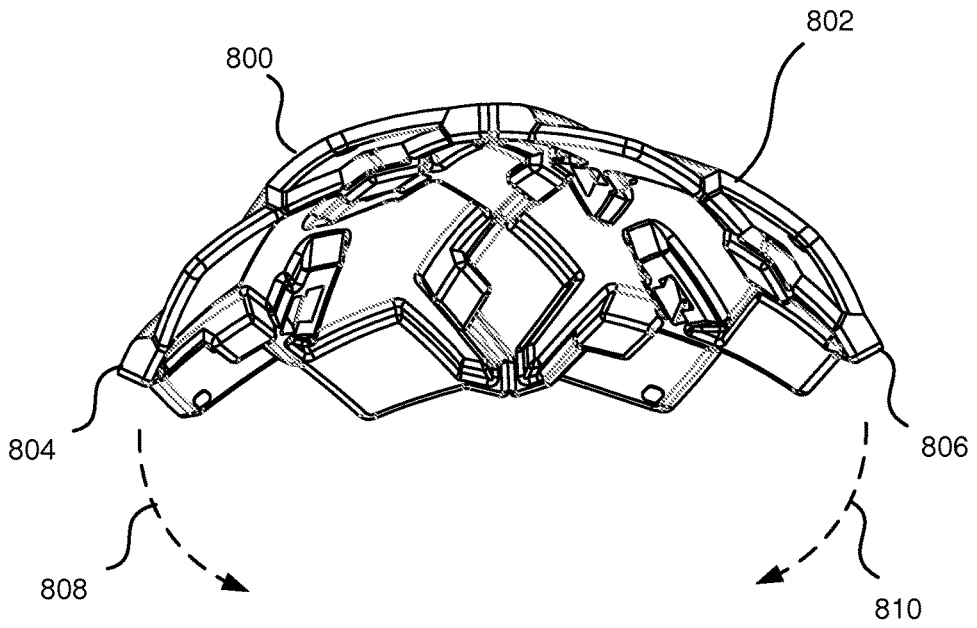
FIG. 8 is a bottom view illustrating two building blocks coupled to one another in accordance with the present subject matter.

FIG. 8 is a bottom view illustrating two building blocks 400*a* and 400*b* coupled to one another in accordance with the present subject matter. The building blocks 400*a* and 400*b* are substantially similar to the building block 400 described above. In certain embodiments, the two building blocks 402*a* and 402*b* are substantially similar to the building blocks 400 described above. The two building blocks 402*a* and 402*b* are coupled to one another in a manner substantially similar to the manner described above. To uncouple the two building blocks 402*a* and 402*b* from one another, a user applies a leverage pressure to opposing ends 804 and 806 of the two building blocks 402*a* and 402*b* in the directions indicated by arrows 808 and 810 respectively.

In certain embodiments, the leveraging pressure operates to disengage the detents 410 on the second projection 412 from the voids 426 in the first recesses 414. The leveraging pressure also disengages the detents 706 on the first projections 410 from the detent recesses 708 in the second recesses 416. Once disengaged, the two building blocks 402*a* and 402*b* can be easily separated by pulling the two building blocks 402*a* and 402*b* apart.

Figure 9:
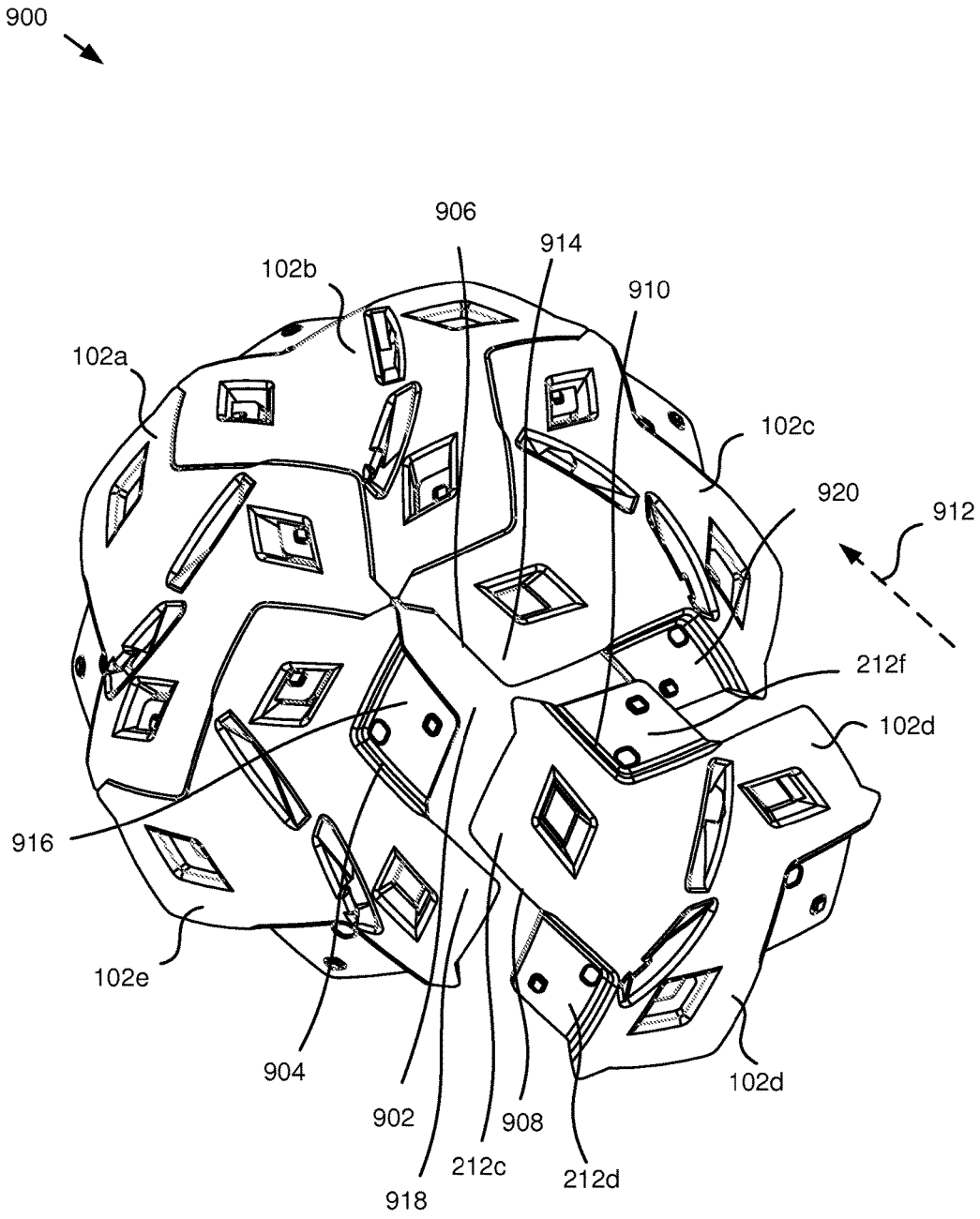
FIG. 9 depicts one embodiment of a portion of an icosahedron which has been exploded onto the surface of a sphere.

FIG. 9 depicts one embodiment of a portion 900 of an icosahedron which has been exploded onto the surface of a sphere. In the embodiment illustrated in FIG. 9, the portion 900 of the icosahedron includes five building blocks 102*a*-102*e* (collectively building blocks 102). One of skill in the art will recognize that a full spherical icosahedron will comprise twenty building blocks 102. The building blocks 102 are substantially similar to the building blocks 102 described above with reference to FIGS. 1-3 above.

As can be seen in the embodiment illustrated in FIG. 9, each building block 102 is shaped such that insertion of a fifth building block 102 is facilitated. For example, in the embodiment illustrated in FIG. 9, building block 102*d* has been removed from the portion 900 of the icosahedron to illustrate the ease with which the building block may be removed or inserted from the portion 900 of the icosahedron. When four building blocks (i.e., building blocks 102*a*, 102*b*, 102*c*, and 102*e*) are coupled to one another the receiving space 902 for the fifth building block (building block 102*d*) includes substantially parallel wall surfaces 904 and 906 for receiving the fifth building block (building block 102*d*). The face angles 908 and 910 of the fifth building block 102*d* are also substantially parallel such that insertion of the fifth building block 102*d* in the direction of arrow 912 is facilitated. As the fifth building block 102*d* is slid into place, the second projection 212*f* on the fifth piece 102*d* slides under the first projection 914 (renamed here for clarity) of building block 102*c*. First projection 212*c* of the fifth building block 102*d* slides over the second projection 916 (renamed here for clarity) of building block 102*e*. The second projection 212*d* slides under the first projection 918 (renamed here for clarity) of building block 102*e* and the first projection 212*e* of the fifth building block 102*d* slides over the second projection 920 (renamed here for clarity) of building block 102*c*. Thus, the fifth building block 102*d* can be easily inserted when constructing an icosahedron.

As discussed above, in certain embodiments, the building blocks 102 may form a truncated icosahedron. For example, in one embodiment, the apparatus may include building blocks 102 of two different sizes. Each of the different sized building blocks 102 may be coupled to additional building blocks of the same size to form pentagons and hexagons. The pentagons and hexagons are coupleable to one another to form a truncated icosahedron.

Figure 10:
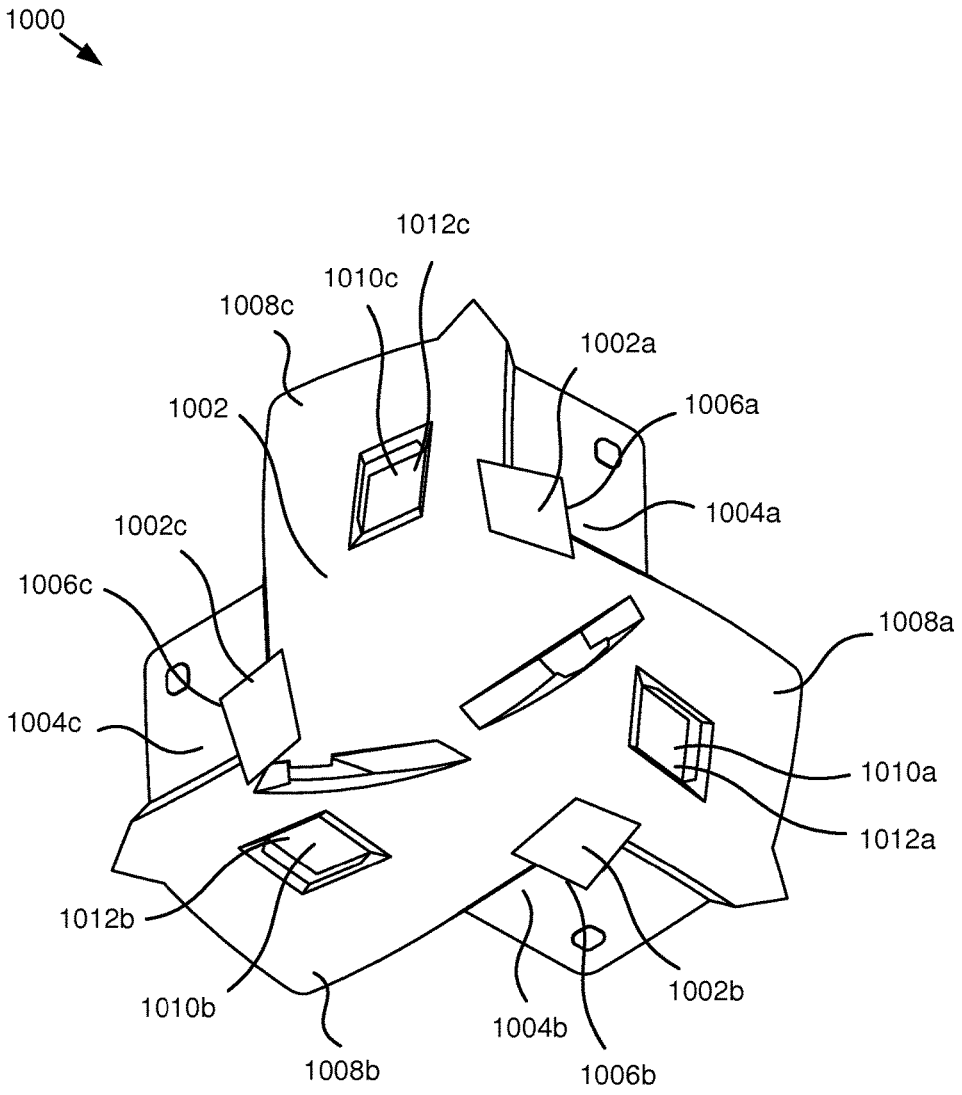
FIG. 10 is a top view illustrating a building block for building a structure in accordance with the present subject matter.

In the embodiments discussed above, the building blocks 102 and 400 include coupling projections 214 and 422 respectively. These coupling projections 214 and 422 are positioned opposite voids 218 and 426 respectively to define gaps 220 and 424 respectively. In other embodiments, the building blocks 102 and 400 may include coupling projections that extend from the outside faces 104 and 404 of the building blocks 102 and 402 respectively. For example, FIG. 10 is a top view illustrating a building block 1000 for building a structure in accordance with the present subject matter. In the embodiment illustrated in FIG. 10, the building block 1000 includes coupling projections 1002*a*-1002*c* (collectively coupling projections 1002) that extend from the outside face 1002 of the building block 1000.

In certain embodiments, the each coupling projection 1002*a*-1002*c* is positioned opposite the second recesses 1006*a*-1006*c* respectively and define gaps 1006*a*-1006*c* for receiving one of the first projections 1008*a*-1008*c* on a second building block. While the second building block is not shown in FIG. 10, one of skill in the art will recognize that the second building block may be constructed substantially similar to building block 1000.

In one embodiment, the building block 1000 also includes coupling projections 1010*a*-1010*c* (collectively coupling projections 1010) which, in the embodiment illustrated in FIG. 10, can be seen through voids 1012*a*-1012*c*. Thus, in certain embodiments, each of the three sides of the building block 1000 includes two coupling projections, one of coupling projections 1002 and another of coupling projections 1010. In other embodiments, the building block 1000 may only include one coupling projection per side (either coupling projections 1002 or coupling projections 1010).

Figure 11:
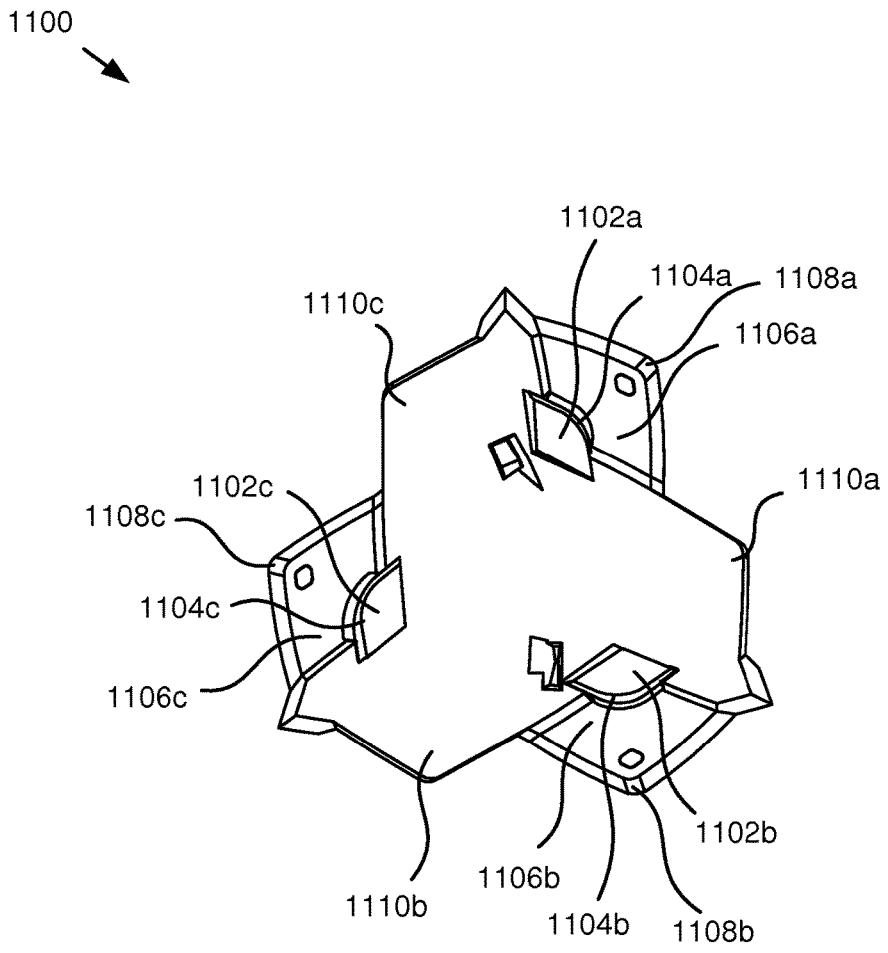
FIG. 11 is a bottom view illustrating a building block for building a structure in accordance with the present subject matter.

In the embodiments discussed above, building blocks 102 and 400 include coupling diamond-shaped coupling projections 214 and 422 respectively. Similarly, building block 1000 includes diamond-shaped coupling projections 1002 and 1010. However, one of skill in the art will recognize that the shape of the coupling projections 214, 422, 1002, and/or 1010 need not be limited to a diamond shape. For example, FIG. 11 is a bottom view illustrating a building block 1100 for building a structure in accordance with the present subject matter. In the embodiment illustrated in FIG. 11, the building block 1000 includes coupling projections 1102*a*-1102*c* (collectively coupling projections 1102) having at least one curved side 1104*a*-1104*c* (collectively curved sides 1104) respectively.

One of skill in the art will recognize that the shape of the curved sides 1104 are not limited to an arc as depicted in FIG. 11. For example, in other embodiments, the curved sides 1104 may be wavy. In yet another embodiment, the coupling projections 1102 may include one or more sides that include hard angles such as triangular angles, squared angles, and the like.

In the embodiment illustrated in FIG. 11, the coupling projections 1102 are positioned opposite the first recesses 1106*a*-1106*c* (collectively first recesses 1106). In other embodiments, the coupling projections 1102 may be positioned opposite the second recesses of the building block 1100 in a manner substantially similar to the manner in which coupling projections 1002 of building block 1000 are positioned opposite the second recesses 1004 of building block 1000 as described above with reference to FIG. 10.

Furthermore, in some embodiments, each of the first recesses 1106 and/or the second recesses (not shown) of building block 1000 may include more than one coupling projections 1102. That is, in certain embodiments, two or more coupling projections 1106 may be positioned opposite a single first recess 1106 and/or a second recess to create two or more gaps for receiving either a first projection 1108*a*-1108*c* or a second projection 1110*a*-1110*c* on a second building block (not shown).

Figure 12:
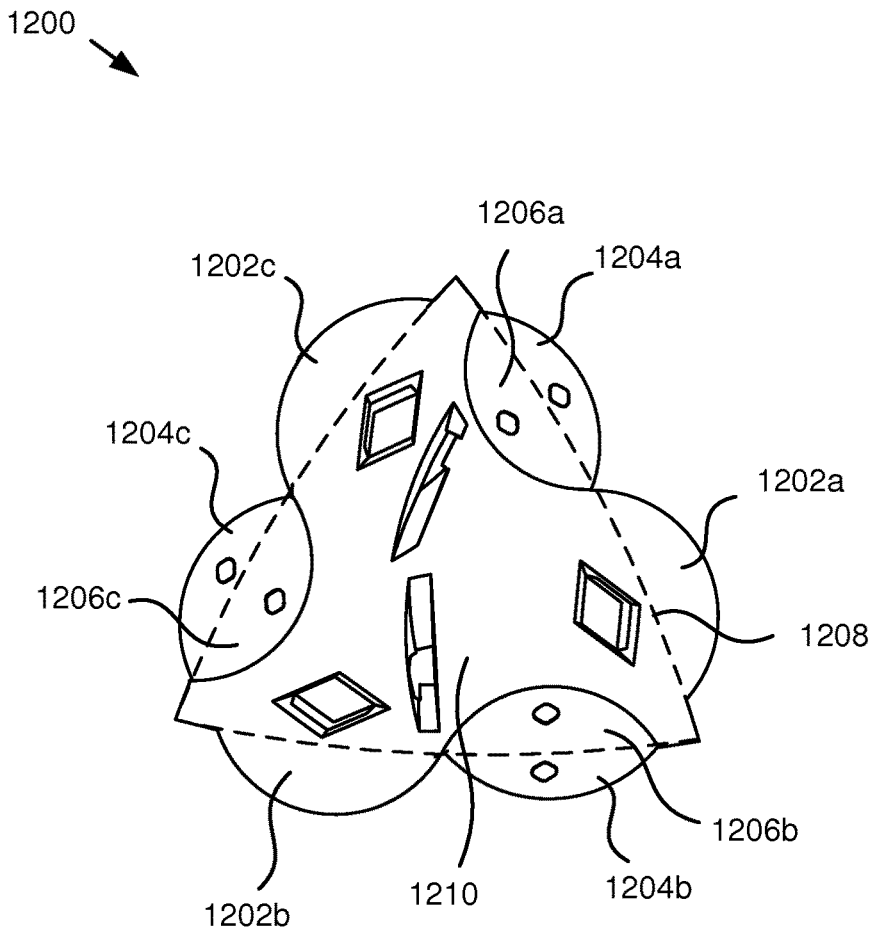
FIG. 12 is a top view illustrating a building block for building a structure in accordance with the present subject matter.

FIG. 12 is a top view illustrating a building block 1200 for building a structure in accordance with the present subject matter. In the embodiment illustrated in FIG. 12, the building block 1200 includes first projections 1202*a*-1202*c* (collectively first projections 1202) which are curved rather than triangular. Similarly, the building block 1200 includes second projections 1204*a*-1204*c* (collectively second projections 1204) which are curved. In the embodiment illustrated in FIG. 12, the second recesses 1206*a*-1206*c* (collectively second recesses 1206) are curved such that a first projection 1202 on a second building block (not shown) may be matingly received within the second recesses 1206. The first recesses (not shown) are hidden by the first projections 1202 in the embodiment illustrated in FIG. 12. One of skill in the art will recognize that the first recesses (not shown), in one embodiment, may be shaped to receive the second projections 1204 on a second building block (not shown). Thus, in certain embodiments, the first recesses (not shown) are also curved to matingly receive the second projections 1204 on a second building block (not shown).

While the first projections 1202 and the second projections 1204 are curved, one of skill in the art will recognize that the building block 1200 is still substantially triangular-shaped. In the embodiment illustrated in FIG. 12, the dashed line 1208 has been added to highlight the triangular cross-sectional shape 1210 of the building block 1200. One of skill in the art will recognize that the dashed line 1208 has been added to FIG. 12 for illustrative purposes and does not form a part of the unique subject matter of the present disclosure.

In other embodiments, the first projections 1202 and the second projections 1204 may have any other geometric shape. For example, in certain embodiments, the first projections 1202 and the second projections 1204 may have a square, rectangular or other geometric cross-sectional shape that extend from the sides of the building blocks.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A building block comprising:

a substantially triangular shape having an outside face opposing an inside face, the outside face connected to the inside face by a first wall, a second wall, and a third wall, wherein the first wall, the second wall, and the third wall each comprises:

a first projection having an outer surface that is continuous with the outside face, the first projection extending away from at least one of the first wall, the second wall, and the third wall, the first projection having a triangular shape, wherein the outer surface of the first projection is convex, a first recess positioned opposite and extending away from the first projection, the first recess disposed in the inside face of the substantially triangular shape, a second projection having an inner surface that is continuous with the inside face, the second projection having a triangular shape, wherein the inner surface of the second projection is concave, the second projection extending away from at least one of the first wall, the second wall, and the third wall, a second recess positioned opposite and extending away from the second projection, the second recess disposed in the outside face of the substantially triangular shape, and a coupling projection positioned opposite at least one of the first recess and the second recess, wherein the coupling projection and the at least one of the first recess and the second recess define a gap for receiving at least a portion of at least one of a first projection and a second projection of a second building block;

wherein the outside face of the substantially triangular shape is convex;

wherein the inside face of the substantially triangular shape is concave;

wherein each of the first wall, the second wall and the third wall is curved.

2. The building block of claim 1, wherein the gap is sized to require at least one of pressure and leverage to matingly receive at least one of the first projection and the second projection of the second building block in the gap.

3. The building block of claim 2, wherein the substantially triangular shape comprises a material having a durometer sufficient to require pressure and leverage to matingly receive at least one of the first projection and the second projection of the second building block in the gap.

4. The building block of claim 3, wherein the substantially triangular shape comprises a material having a durometer within a range of 40-95.

5. The building block of claim 1, further comprising a void that extends through the building block from the outside face to the inside face, wherein the coupling projection is positioned opposite the void.

6. The building block of claim 5, wherein at least one of the first projection and the second projection includes at least one detent, the at least one detent shaped to removably engage a void on a second building block.

7. The building block of claim 6, wherein the at least one detent and the void are sized to require leverage and pressure to removably engage at least one detent with the void.

8. The building block of claim 1, wherein the outside face of the substantially triangular shape is shaped as a portion of an outer surface of a sphere.

9. The building block of claim 1, wherein building block comprises a first building block and wherein the outside face of the first building block comprises a coupling element configured to couple a second building block to the outside face of the first building block.

10. The building block of claim 9, wherein the coupling element comprises at least one receiving slot sized to receive at least one of a first projection and a second projection of the second building block.

11. The building block of claim 9, wherein the second building block includes an outside face positioned opposite an inside face, wherein the outside face and the inside face of the second building block extend substantially perpendicularly away from the outside face of the first building block when the second building block is coupled to the first building block.

12. The building block of claim 1, further comprising a first magnetic element and a second magnetic element, the first magnetic element positioned on at least one of the first projection and the second projection, the second magnetic element positioned in at least one of the first recess and the second recess, the first magnetic element magnetically coupleable to the second magnetic element.

13. An apparatus for building a structure, the apparatus comprising:

a first building block and a second building block, each building block comprising a substantially triangular shape having an outside face opposing an inside face, the outside face connected to the inside face by a first wall, a second wall, and a third wall, each of the first wall, the second wall, and the third wall comprising:

a first projection having an outer surface that is continuous with the outside face, the first projection having a triangular shape, a first recess positioned opposite and extending away from the first projection, the first recess disposed in the inside face of the substantially triangular shape, a second projection having an inner surface that is continuous with the inside face, the second projection having a triangular shape, a second recess positioned opposite and extending away from the second projection, the second recess disposed in the outside face of the substantially triangular shape, and a coupling projection positioned opposite the first recess, wherein the coupling projection and the first recess define a gap for receiving at least a portion of a second projection on the second building block, wherein the gap is sized to require at least one of pressure and leverage to matingly receive at least one of the first projection and the second projection of the second building block in the gap.

14. The apparatus of claim 13, wherein the substantially triangular shape comprises a material having a durometer within a range of 40-95.

15. The apparatus of claim 13, further comprising a void that extends through the building block from the outside face to the inside face, wherein the coupling projection is positioned opposite the void, wherein the second projection includes at least one detent shaped to removably engage the void on the second building block.

16. The apparatus of claim 15, wherein the at least one detent and the void are sized to require leverage and pressure to removably engage the at least one detent with the void.

17. The apparatus of claim 13, wherein the outside face of each building block comprises a coupling element coupleable with at least one of a first projection and a second projection on another building block.

18. An apparatus for building a structure, the apparatus comprising:

a first building block and a second building block, each building block comprising a material having a durometer within a range of 40-95, wherein each building block comprises a substantially triangular cross-sectional shape having an outside face opposing an inside face, the outside face connected to the inside face by a first wall, a second wall, and a third wall, each of the first wall, the second wall, and the third wall comprising:

a first projection having an outer surface that is continuous with the outside face, the first projection having a triangular shape, a first recess positioned opposite and extending away from the first projection, the first recess disposed in the inside face of the substantially triangular shape, a second projection having an inner surface that is continuous with the inside face, the second projection having a triangular shape, a second recess positioned opposite and extending away from the second projection, the second recess disposed in the outside face of the substantially triangular shape, and a coupling projection positioned opposite the first recess, wherein the coupling projection and the first recess define a gap for receiving at least a portion of a second projection on the second building block, wherein the gap is sized to require at least one of pressure and leverage to matingly receive at least one of the first projection and the second projection of the second building block in the gap.

19. The apparatus of claim 18, further comprising a void that extends through the building block from the outside face to the inside face, wherein the coupling projection is positioned opposite the void, wherein the second projection includes at least one detent shaped to removably engage the void on the second building block.

20. The apparatus of claim 19, wherein the at least one detent and the void are sized to require leverage and pressure to removably engage the at least one detent with the void.

21. An apparatus for building a structure, said apparatus comprising:

a plurality of blocks, each of the plurality of blocks comprising a substantially triangular shape having an outside face opposing an inside face, the outside face connected to the inside face by a first wall, a second wall, and a third wall;

wherein the first wall, the second wall, and the third wall of each of the plurality of blocks comprises:

a first projection having an outer surface that is continuous with the outside face, the first projection extending away from at least one of the first wall, the second wall, and the third wall, a first recess positioned opposite and extending away from the first projection, the first recess disposed in the inside face of the substantially triangular shape, a second projection having an inner surface that is continuous with the inside face, the second projection extending away from at least one of the first wall, the second wall, and the third wall, a second recess positioned opposite and extending away from the second projection, the second recess disposed in the outside face of the substantially triangular shape, and a coupling projection positioned opposite at least one of the first recess and the second recess, wherein the coupling projection and the at least one of the first recess and the second recess define a gap for receiving at least a portion of at least one of a first projection and a second projection of a second building block, wherein the outer surface of the first projection is convex, wherein the inner surface of the second projection is concave;

wherein the outside face of the substantially triangular shape of each of the plurality of blocks is convex;

wherein the inside face of the substantially triangular shape each of the plurality of blocks is concave;

wherein the first wall, the second wall and the third wall each of the plurality of blocks is curved.

22. The apparatus of claim 21, wherein the plurality of blocks is configured and dimensioned to interconnect to form a shape of a sphere.

23. The apparatus of claim 21, wherein the plurality of blocks is configured and dimensioned to interconnect to form a shape of a partial sphere.

* * * * *